US007014524B2

(12) United States Patent
Farmer Brock et al.

(10) Patent No.: US 7,014,524 B2
(45) Date of Patent: Mar. 21, 2006

(54) INTERCHANGEABLE PANEL, MODULAR DISPLAY SYSTEM

(75) Inventors: Mary E. Farmer Brock, Rockwall, TX (US); John J. McGeough, Carrollton, TX (US)

(73) Assignee: Mary Farmer Brock, Rockwall, TX (US)

( * ) Notice: Subject to any disclaimer, the term of this patent is extended or adjusted under 35 U.S.C. 154(b) by 380 days.

(21) Appl. No.: 09/327,593

(22) Filed: Jun. 8, 1999

(65) Prior Publication Data

US 2002/0061711 A1 May 23, 2002

Related U.S. Application Data

(60) Provisional application No. 60/090,376, filed on Jun. 22, 1998.

(51) Int. Cl.
*A63J 19/00* (2006.01)

(52) U.S. Cl. ..... 446/82; 446/476

(58) Field of Classification Search ..... 446/82, 446/476, 478, 479, 487, 488, 489, 83, 84; 52/27, 272, 408

See application file for complete search history.

(56) References Cited

U.S. PATENT DOCUMENTS

| | | | | | |
|---|---|---|---|---|---|
| 1,155,523 | A | | 10/1915 | Smith | |
| 1,863,995 | A | | 6/1932 | Ponstingl | |
| 1,898,297 | A | | 2/1933 | Fox | |
| 3,132,443 | A | | 5/1964 | Kahn | 46/28 |
| 3,906,659 | A | | 9/1975 | Walmer | 46/19 |
| 3,975,876 | A | | 8/1976 | Sauder | 52/282 |
| 3,996,693 | A | | 12/1976 | Walmer | 46/19 |
| 4,018,001 | A | | 4/1977 | Walmer | 46/19 |
| 4,021,960 | A | | 5/1977 | Walmer | 46/19 |
| 4,071,984 | A | | 2/1978 | Larrow | 52/79.1 |
| 4,094,090 | A | | 6/1978 | Walmer | 46/19 |
| 4,216,608 | A | | 8/1980 | Walmer et al. | 46/19 |
| 4,269,006 | A | | 5/1981 | Larrow | 52/79.1 |
| 4,432,590 | A | | 2/1984 | Lawrence | 312/257 |
| 4,458,461 | A | | 7/1984 | Holley | 52/239 |
| 4,508,519 | A | * | 4/1985 | Becker | 446/478 |
| 4,584,801 | A | | 4/1986 | Weinberger | 52/64 |
| 4,723,820 | A | | 2/1988 | Kroneck | 312/223 |
| 5,055,083 | A | * | 10/1991 | Walker et al. | 446/476 |
| 5,261,849 | A | * | 11/1993 | French | 446/82 |
| 5,495,686 | A | | 3/1996 | Millard et al. | 40/621 |
| 6,065,253 | A | * | 5/2000 | Ojeda | 446/478 |

* cited by examiner

*Primary Examiner*—Sam Rimell
(74) *Attorney, Agent, or Firm*—Philip G. Meyers

(57) ABSTRACT

An interchangeable panel, modular display system for use as a doll house or miniature display case includes a modular frame with at least one wall section having grooves for slidably receiving a wall panel therein. The frame also includes an opening for inserting a wall panel into and removing a wall panel from the wall section. Each wall panel includes a flat, rigid support, a magnetically attractable layer, and a decorative cover layer. Magnetically attractable decorations can be removably attached at selected locations on the wall panel.

20 Claims, 5 Drawing Sheets

INTERCHANGEABLE PANEL, MODULAR DISPLAY SYSTEM

This application claims priority of U.S. Provisional Application No. 60/090,376, filed Jun. 22, 1998.

TECHNICAL FIELD

This invention relates to miniature display cases, particularly to doll houses in which the appearance, size, and shape of the doll house can be quickly and easily changed.

BACKGROUND OF THE INVENTION

Doll houses and miniature rooms of various types have been previously designed. Generally, these doll houses are prefabricated and do not permit simple and convenient alterations to the appearance of the doll house's exterior or to individual rooms in the doll house. In addition, such doll houses have a specific shape and size that cannot be changed. For example, see Walmer, U.S. Pat. No. 3,906,659, issued Sep. 23, 1975; Walmer, U.S. Pat. No. 4,018,001, issued Apr. 19, 1977; Walmer, U.S. Pat. No. 4,094,090, issued Jun. 13, 1978; and Kroneck, U.S. Pat. No. 4,723,820, issued Feb. 9, 1988. Such constructions are useful as toys and for creating miniature displays but lack the ability to conveniently decorate and customize the appearance, size, and shape of the doll house or display case. The present invention addresses these problems and deficiencies with the prior art.

SUMMARY OF THE INVENTION

An interchangeable panel display system according to the invention includes a frame and one or more wall panels that fit into the frame. The frame has a base and at least one wall section positionable in an upright position when the base is placed horizontally on a surface. The wall section has grooves for slidably receiving a wall panel therein and an opening or slot for inserting a wall panel into the grooves and for removing the wall panel from the grooves. A wall panel is slidably inserted into the grooves of the wall section. The wall panel comprises a support and a decorative cover or surface disposed on at least one side of the support. Preferably, at least three wall sections are provided on three sides of a rectangular base so that a stage-like scene may be set inside the display using either or both of wall-mounted and free standing decorations.

The invention further provides an interchangeable panel display kit usable to make an interchangeable panel display system as described above. Such a kit includes at minimum at least one frame and a plurality of wall panels having a variety of decorative surfaces so that the appearance of the display system can be changed by removal and replacement of the wall panels. The kit may further include a set of decorations for use in making displays, especially magnetically attachable decorations as described in the detailed description that follows.

According to a further aspect of the invention, the frame may be any one providing sufficient mechanical support, for example, a molded plastic base with grooves for insertion of wall sections and snap-on plastic connectors for securing the upper ends of adjacent wall panels. The removable wall panels comprise a flat, substantially rigid support, a magnetically attractable layer, and a decorative cover. The magnetically attractable layer allows magnetically attractable decorations to be removably attached at selected locations on the wall panels. Thus, the decorations and appearance of each individual room in the display system can be quickly and easily changed. For purposes of the invention, "substantially rigid" refers to a support that is stiff and self-supporting in the manner of cardboard or paperboard.

The invention additionally provides a method of using an interchangeable panel modular display system which takes advantage of the flexibility of the display. The method includes the initial step of positioning the base on a horizontal surface. One or more first wall panels are positioned on the frame so that each wall panel stands upright with its decorative surface facing inwardly. Decorations are placed in positions on or near the wall panels to form a first scene. The first wall panels are then removed from the frame, and one or more second wall panels are mounted on the frame so that wall panels stand upright with the decorative surfaces facing inwardly. The second wall panels have different decorative surfaces than the first wall panels. The decorations are repositioned, i.e., removed and substituted as necessary, to create a second scene different from the first scene. In this manner, the display system of the invention can be used in an unlimited variety of ways, depending on the supply of wall panels and decorative material available. These and other advantages of the invention will become evident from the detailed description that follows.

BRIEF DESCRIPTION OF THE DRAWINGS

The preferred embodiments of the invention are further described with reference to the accompanying drawings, wherein like reference characters denote like parts, wherein:

FIG. 1 is a front perspective view of one module of the display system of the invention;

DETAILED DESCRIPTION

Figure 4:
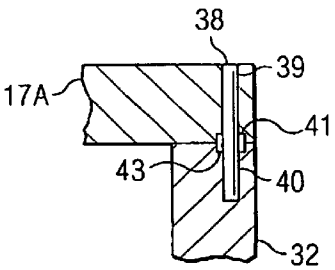
FIG. 4 is a partial, vertical sectional view of the upper right front corner of the frame shown in FIG. 2.

The interchangeable panel modular display system of the invention allows model room displays to be quickly and easily changed. The system is particularly useful for an interchangeable panel doll house, although the invention can also be used to create dioramas, to demonstrate stage setups in the theater industry, for church settings, or to display interior or exterior design concepts.

Referring now to FIG. 1, there is shown a perspective view of a display 2, in this example a doll house room, having wall panels according to the invention. Doll house room 2 includes a rigid rectangular frame 10, wall panels 20A, 20B slidably mounted in grooves in frame 10 as described hereafter, and magnetically attractable decorations 46 removably attached at desired locations on the insides of wall panels 20A, 20B in a manner effective to depict a miniature room or other location. A floor panel 48 and a ceiling panel 50 may also be provided. Frame 10 has a horizontal, rectangular base section 12, a horizontal, rectangular ceiling section 16 of the same dimensions as base section 12, and four vertical wall sections 14 which span the base and ceiling sections 12, 16. Wall sections 14 each include associated portions of each of two spaced upright posts 32 and a wall panel 20A or 20B, if present. Frame 10 is constructed from plastic, metal, wood, or any other suitable rigid material. Since children may try to climb on top of frame 10 when used as a doll house, frame 10 should be sufficiently strong to support the weight of a child.

Figure 3:
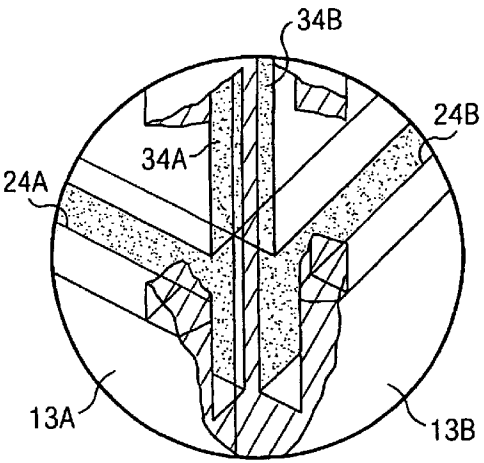
FIG. 3 is an enlarged perspective view, partly in section and partly broken away, of the lower right front corner of the frame shown in FIG. 2.
Figure 2:
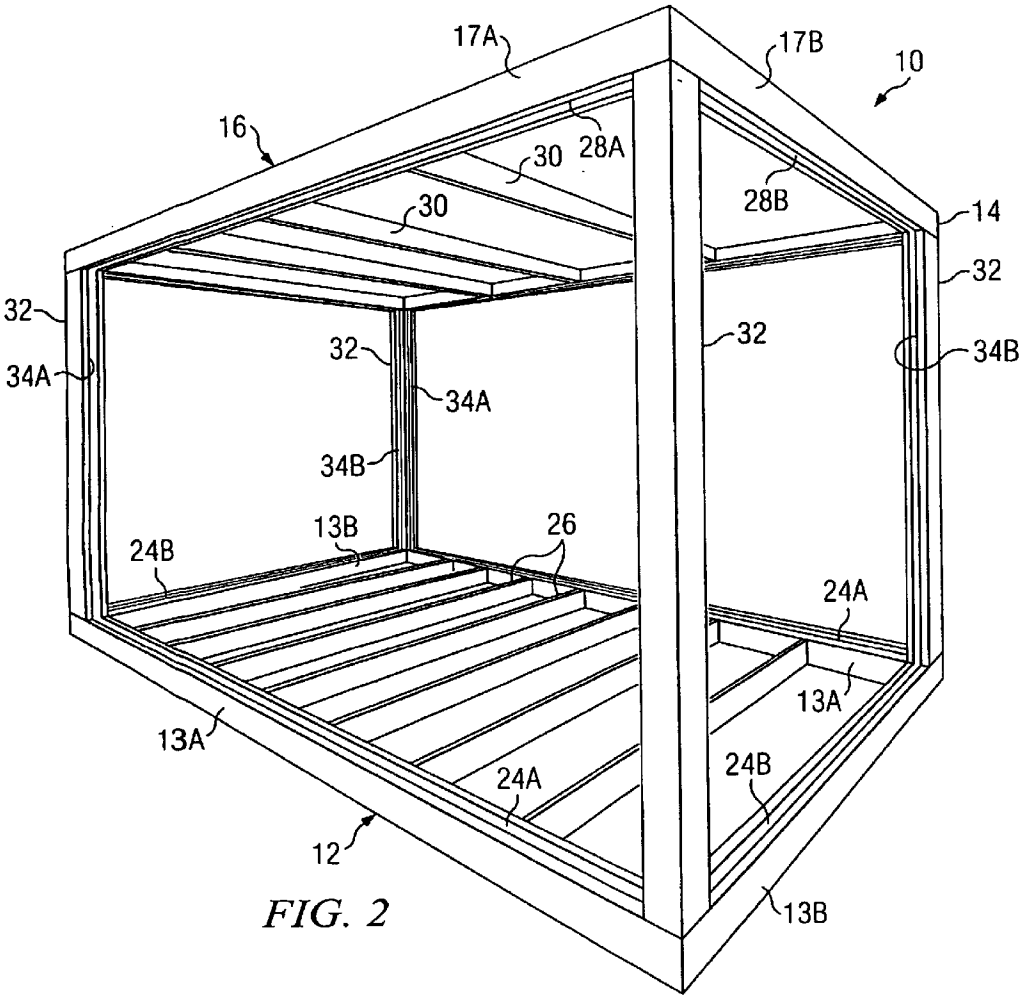
FIG. 2 is a perspective front corner perspective view of the frame of the display system module shown in FIG. 1.

Referring now to FIGS. 2 and 3, rectangular base section 12 is made up of pairs of long beams 13A and short beams 13B. Each beam has an upwardly opening slot 24A or 24B sized to receive a bottom edge of a wall panel 20A, 20B (see FIG. 1). Grooves 24A, 24B preferably extend all or most of the length of each beam 13A, 13B. The bottom of each groove 24A, 24B provides a support for the bottom edge of wall panel 20, and the sides of each groove 24A, 24B maintain the lower portion of the associated wall panel 20A, 20B in position along the side of frame 10. A series of parallel, spaced lower crossbars 26 interconnect long beams 13A to increase the rigidity of base section 12, and a set of upper crossbars 30 perform a similar function for ceiling section 16.

Figure 5:
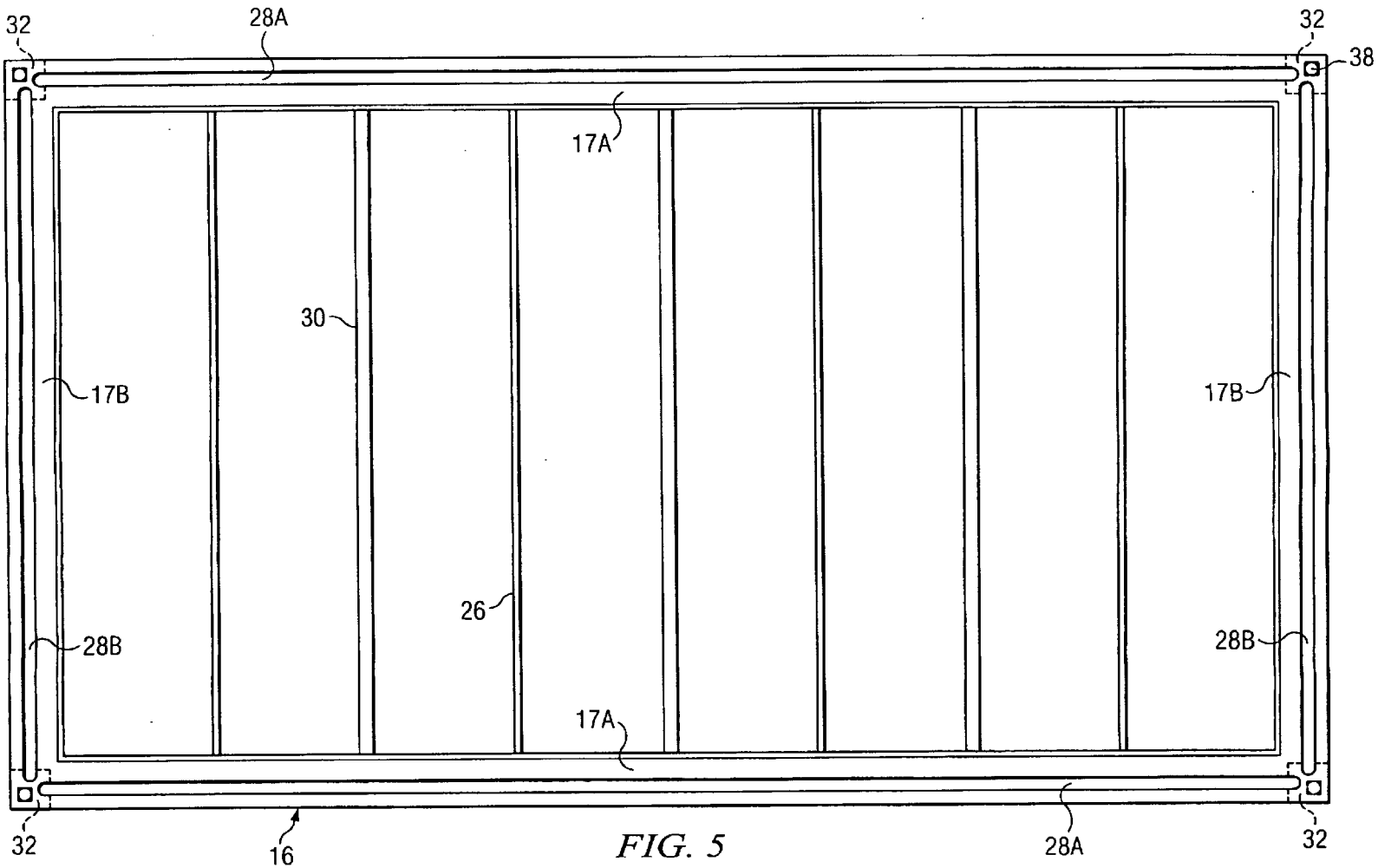
FIG. 5 is a top plan view of the frame of the display system shown in FIG. 2.

Rectangular ceiling section 16 is made up of pairs of long beams 17A and short beams 17B. Each beam 17A, 17B has an elongated vertical slot 28A or 28B sized to receive a wall panel 20A or 20B. Slots 28A, 28B extend nearly all the length of each beam 17A, 17B, except at the corners (see FIG. 5). Slots 28A, 28B extend all the way through beams 17A, 17B and are sized to allow insertion of wall panels 20A, 20B respectively into frame 10 from the top as shown in FIG. 5. For each side of ceiling section 16, each slot 28A, 28B is co-planar with corresponding groove 24A, 24B of base section 12 so that square or rectangular panels fit easily in and out. The sides of each slot 28A, 28B hold the upper end portion of the associated wall panels 20A, 20B in position along the side of frame 10 in the same manner as lower grooves 24A, 24B.

Frame 10 further includes four vertical posts 32 at each corner. Each end of each post 32 is attached to a corner of base section 12 by a steel pin 38 (FIG. 4). Each pin 38 is inserted through an aperture 39 in base section 12 or ceiling section 16 and into an aligned aperture 40 at the upper or lower end of post 32. Metal fittings (keys) 41 are set in shallow recesses 43 at opposite ends of each post 32, and are glued therein with a suitable adhesive, such as CA glue. The central opening of each key 41, which is aligned with apertures 39 and 40, is about 1/1000 smaller in diameter than the outer diameter of pin 38, so that each pin 38 is press-fitted into apertures 39, 40 and upper and lower frame sections 12, 16 securely together by means of vertical posts 32.

Referring again to FIG. 2, each post 32 includes a long side vertical groove 34A and a short side vertical groove 34B extending the length of the post and set at a 90 degree angle from each other for slidably receiving wall panels 20A, 20B, respectively. Groove 34A in each post 32 is co-planar with groove 24A of base section 12 and slot 28A of ceiling section 16. Groove 34B of post 32 is similarly co-planar with groove 24B and slot 28B of an adjacent side of frame 10. Each adjacent pair of posts 32, in combination with a pair of beams 13A, 17A or 13B, 17B, form a wall section 14.

A pair of grooves 34A together with a groove 24A and a slot 28A form a long side rectangular track into which a long wall 20A can be readily inserted or removed. In the same fashion, a pair of grooves 34B together with a groove 24B and a slot 28B form a short side rectangular track into which a short wall 20B can be inserted. When so inserted, the edges of the walls 20A, 20B are concealed in the track, but most of the inner and outer face of each wall is visible as shown in FIG. 1. As illustrated in FIG. 3, the ends of grooves 24A, 34A and 24B, 34B merge at the upper and lower ends of posts 32.

Figure 6:
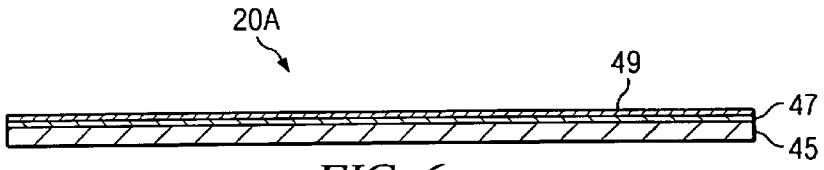
FIG. 6 is a cross-sectional view of a wall panel used in the display system of FIG. 1.

Referring to FIG. 6, each wall panel 20A, 20B preferably includes a flat, stiff support sheet 45 of cardboard, wood, plastic, or similar material. A magnetically attractable layer 47 and a decorative cover sheet 49 are successively disposed on one side the support to form the decorative inner face of the wall section 20A, 20B. Decorative sheet 49 typically comprises a laminated paper or a plastic film that covers the magnetically attractable layer.

Magnetically attractable layer 47 may be itself magnetic, or made of a material attracted by a magnet, such as a ferrous material. In one embodiment, the magnetically attractable layer comprises a flat metallic or magnetic sheet or foil that is secured to one side of the rigid support by an adhesive. A layer of magnetically attractable particles, such as iron filings, dispersed in an adhesive binder can also be used. In another embodiment, the magnetically attractable layer is a thin coating of a cured (cross-linked) acrylic polymer in which small, magnetically active particles, such as iron particles, are dispersed. Such compositions are well known in the art. Since it is easier to provide a magnet in the decoration to be mounted on the wall rather than in the wall itself, it is most preferred to use a non-magnetic but magnetically attractable material such as a thin metal foil as the layer 47.

Decorative cover sheet 49 is attached over the support 45 and magnetically attractable layer by a suitable adhesive. Cover sheet 49 is made of paper or a latex-impregnated cloth and has the appearance of wallpaper, a mural, outdoor scenery, or similar decor. Cover sheet 49 can also include representations of windows, doors, paintings, shelves, or similar objects. Preferably, cover sheet 49 has approximately the same dimensions as support 45 so that it completely covers and conceals support 45 and magnetically attractable layer 47. In another embodiment, wall panels 20A, 20B include openings for translucent windows and functional doors that can be opened and closed. In this case, the cover sheet 49 is shaped to fit around such doors and windows in the same manner as real wallpaper (and indeed, real wallpaper can be used as cover sheet 49).

Figure 8:
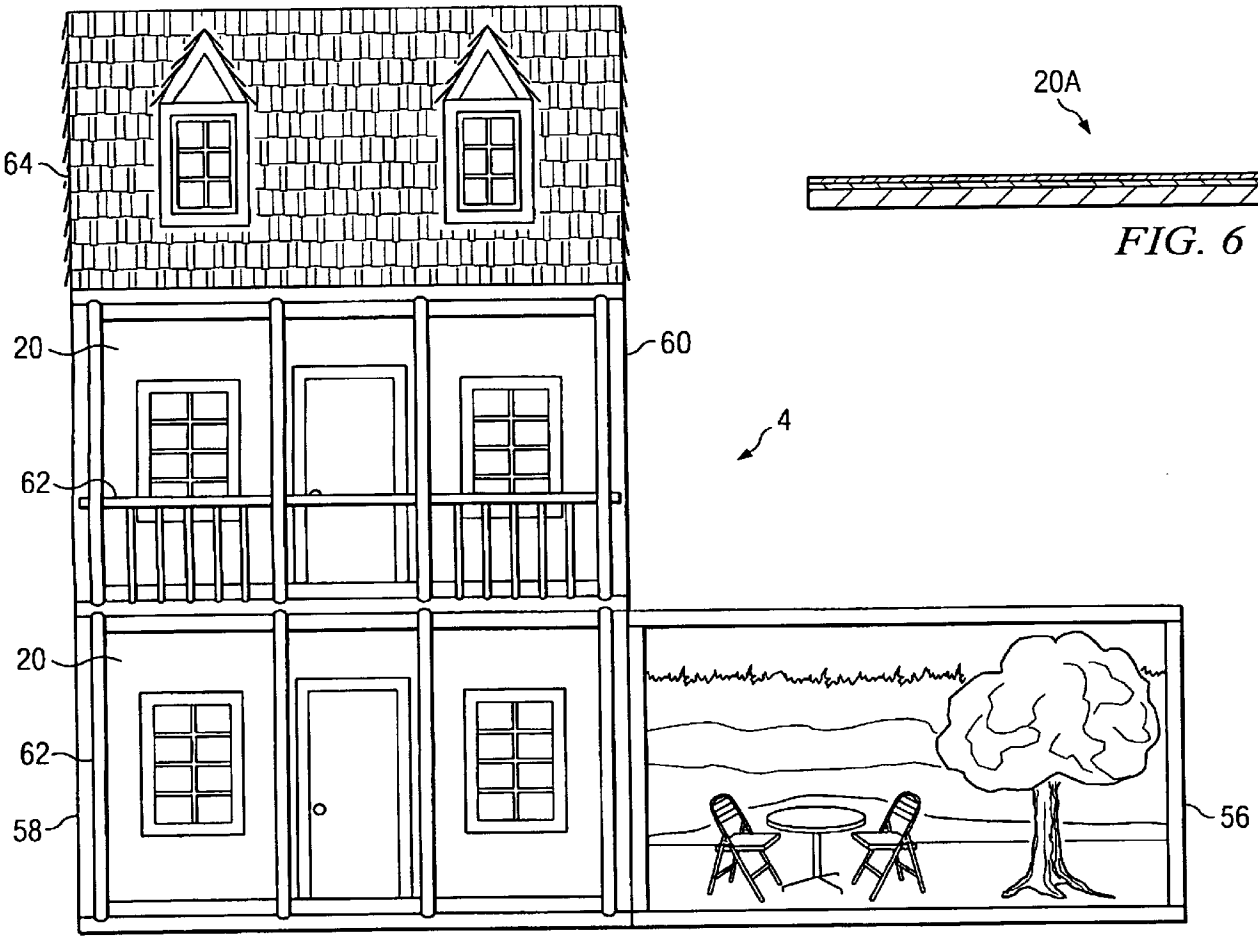
FIG. 8 is a front view of a multiple module display system in accordance with the invention.

Floor panel 48 is placed over base section 12, and may be either removable or permanently attached. A slightly recessed inner rectangular area (not shown) in base section 12 may be sized to receive floor panel 48, or floor panel 48 may be secured to the upper side of base section 12 by fasteners or an adhesive, as desired. Crossbars 26 provide support for floor panel 48. Floor panel 48 preferably comprises a flat, rigid support similar to support 45 and a cover layer adhesively attached thereto on its upper face similar to cover 49 which be decorated as a floor or with carpeting. In another embodiment, floor panel 48 is similar to wall panels 20A, 20B and includes a flat, rigid support, a magnetically attractable layer, and a decorative cover sheet disposed on the support. This permits use of magnets in the bases of free-standing decorations 52, 54 to prevent the display from becoming disturbed by casual handling. Floor panel 48 can also include openings for the addition of stairways when a module 2 is used in a stacked configuration as shown in FIG. 8.

Ceiling panel 50 is sized to mate with ceiling section 16 in a similar manner, and can be constructed in the same or a similar manner to wall panels 20A, 20B or floor panel 48. Ceiling panel 50 can be either removable or permanently attached to ceiling section 16.

Figure 7:
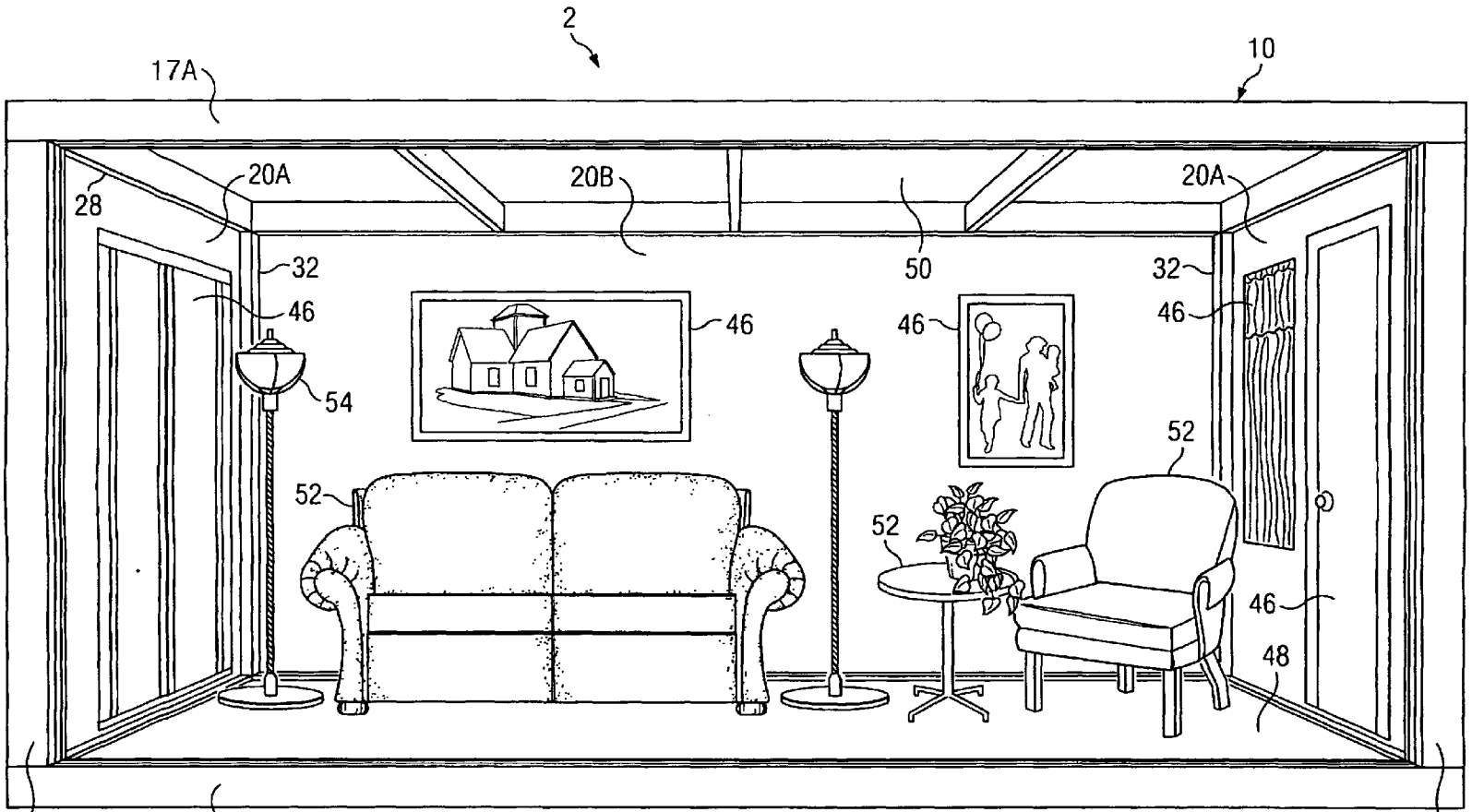
FIG. 7 is a front perspective view of a module of the display system of the invention in a fully decorated condition.

Referring to FIG. 7, which shows display 2 fully assembled, magnetically attractable decorations 46 are selectively attached to wall panels 20. Decorations 46 may be relatively large, flat objects such as the paintings, curtains, false door and false window shown. Smaller molded plastic items having magnets in the base thereof, such as a real or dummy wall mounted lamp, may also be used as decorations 46. Large, flat decorations 46 generally have a bilayer construction well known in the art which generally comprises a sheet of flexible, rubberized magnetic material disposed on a flexible, flat plastic substrate and having a decorative pattern molded or printed on one side thereof. Decorations 46 can also be constructed in a manner similar to wall panels 20, as described above.

The magnetic attraction between decoration 46 and the inside of wall panel 20A, 20B is sufficient to maintain decoration 46 in a selected position on wall panel 20A, 20B when the wall panel is in a vertical display position. Decorations 46 are also easily removable from wall panel 20A or 20B and can be removed and reattached as desired. In addition, three-dimensional free standing decorations including miniature furniture 52, lamps 54, appliances, stairways, and other decor can also be placed in the room to further enhance the display. Once the selected wall panel has been inserted into frame 10, decorations 46 can be selectively positioned on wall panel 20A or 20B and magnetically attached.

Referring now to FIG. 8, there is illustrated a multiple-module display 4 in accordance with the present invention. Multiple-module display 4 includes a first module 56 arranged with an outdoor or garden-type display. Second and third modules 58 and 60 are closed in or have a rearwardly facing open side, and are stacked on one another. Each has a porch or balcony attachment 62. Porch attachment 62 can be removable or can be permanently attached or integrally formed with modules 58 and 60. The modules of the invention are stackable and are made in standard sizes so as to enable the design of multiple room displays. A stackable attic module 64 is also provided.

A kit according to the invention preferably includes at least one frame 10 in assembled or unassembled form, along with a plurality of wall sections of different surface designs for making different scenes. In particular, wall panels included in the kit may include sets or subsets of two or more panels having matching or coordinated decorative covers. Matching in this case refers to identical or nearly identical patterns, such as three panels (two short, one long) for which the inner decorative cover is a common pattern of wall paper. An example of a coordinated set or subset of wall panels would be three walls made to depict a kitchen, three more made to depict a dining room, and so on. The panels of each subset may also have a distinct theme, such as the inside of a log cabin or the control room of a spaceship.

In a further embodiment of the kit, the decorative surface layers may be a number of flexible plastic or rubberized decals of a type well known in the art that cling to a glossy cardboard surface. In this manner, only a single set of walls is provided, and the user changes scenes by peeling off one background and laying on another, then if necessary re-mounting the wall panel on the frame.

The kit of the invention can be used to make a series of different scenes using different interchangable wall panels and appropriate decorations. For this purpose several sets of wall panels may be provided that are decorated on one side only, or have decorations on both sides, so that changing scenes can be accomplished by reversing each panel so that former outsides face inside. However, it may be most preferable to provide the outer faces of the wall panels with a decorative surface of cover that corresponds to the outside of the scene shown by the inner surfaces of the wall panels. In the case of a doll house, the outer cover, which may be directly adhered to the support, may show a brick home exterior, whereas the inside cover of the wall panel shows the interior of a room.

Although a preferred embodiment of the invention has been illustrated in the accompanying drawings and described in the foregoing detailed description, it will be understood that the invention is not limited to the embodiment disclosed, but is capable of numerous rearrangements and modifications of parts and elements without departing from the spirit of the invention. For example, a five-layer wall panel could be provided which is capable of supporting decorations on both its inner and outer sides, or the wall panel may be a monolayer in which the cover is a contoured or printed-on design. The slots provided in the beams making up the ceiling section could be provided in the posts instead, so that the wall panels are inserted end-first horizontally rather than vertically. These and other equivalent modifications are within the scope of the appended claims.

What is claimed is:

1. An interchangeable panel, display system, comprising:

a frame including a base, a first wall section positionable in an upright position when the base is placed horizontally on a surface, which first wall section has at least one groove for slidably receiving a wall panel therein for display in an upright position and an opening for inserting a wall panel into the groove and for removing the wall panel from the groove, and a second wall section positionable in an upright position when the base is placed horizontally on a surface, which second wall section has at least one groove for slidably receiving a wall panel therein for display in an upright position and an opening for inserting a wall panel into the groove and for removing the wall panel from the groove, the first and second wall sections being mounted along two adjoining edges of the base;

a first wall panel slidably insertable into and removable from the groove of the first wall section, the first wall panel comprising a support having a first decorative surface disposed on at least one side of the support, which first decorative surface has a first design thereon; and a second wall panel slidably insertable into and removable from the groove of the second wall section, the second wall panel comprising a support having a second decorative surface disposed on at least one side of the support, which second decorative surface has a second design thereon that is different from the first design, wherein the first and second designs cooperate to depict a predetermined miniature environment.

2. The display system of claim 1, wherein the predetermined miniature environment comprises miniature interior building decor.

3. The display system of claim 2, wherein the first and second wall panels simulate in miniature adjacent walls of an interior room.

4. The display system of claim 1, wherein the decorative surface comprises a decorative cover, and the first wall panel further comprises a magnetically attractable layer disposed on one side of the support beneath the cover.

5. The display system of claim 1, wherein the base and wall sections are each rectangular.

6. The display system of claim 1, wherein the first wall section comprises two parallel, spaced, upright posts, each post having a longitudinal groove for slidably receiving the wall panel therein.

7. The display system of claim 6, wherein the base includes a groove in alignment with the longitudinal grooves in the posts and spanning the posts for receiving a lower edge of the first wall panel therein.

8. The display system of claim 1, wherein the first wall section comprises an open rectangular frame having a pair of parallel posts mounted at two adjacent corners of the base and a beam spanning upper ends of each post, each post having a longitudinal, inwardly facing groove forslidably receiving the wall panel therein and the beam having a slot therethrough in alignment with the grooves in the posts, which slot comprises the opening in the frame for inserting the wall panel.

9. The display system of claim 5, wherein the frame comprises three wall sections which include four posts mounted at four corners of the base and four upper beams spanning the four posts, wherein at least three wall sections comprise an open rectangular frame defined by:

a pair of parallel posts mounted at two adjacent corners of the base with one of the beams spanning upper ends of the pair of posts, each post of the pair having a longitudinal, inwardly facing groove for slidably receiving the wall panel therein, and the beam having a slot therethrough in alignment with the grooves in the posts, which slot comprises the opening in the frame for inserting the wall panel.

10. The display system of claim 4, further comprising one or more magnetically attractable decorations, wherein at least one of the decorations and the magnetically attractable layer of the wall panel comprises a magnetic material.

11. The display system of claim 1, wherein the predetermined miniature environment comprises outdoor scenery.

12. The display system of claim 2, wherein one of the first and second designs includes a miniature representation of a wall-mounted object.

13. The display system of claim 12, wherein the object is selected from a door, window, painting or shelf.

14. An interchangeable panel, display system, comprising:

a frame including a base and a wall section comprising an open rectangular frame having a pair of parallel posts mounted at two adjacent corners of the base, each post having a longitudinal, inwardly facing groove and a beam spanning upper ends of each post, the beam having a slot therethrough; and wherein at least one wall panel is removably received in the grooves on the frame through the slot, the wall panel comprising a support, a decorative cover disposed on at least one side of the support, and a magnetically attractable layer disposed on the one side of the support beneath the cover layer.

15. The display system of claim 14, further comprising one or more magnetically attractable decorations, wherein at least one of the decorations and the magnetically attractable layer of the wall panel comprises a magnetic material.

16. A method of using an interchangeable panel modular display system, which display system includes a frame having a base and means for supporting a wall panel in an upright position when the base is placed horizontally on a surface, which means permits insertion and removal of wall panels, and a plurality of wall panels removably mountable on the frame, each wall panel comprising a support and a decorative surface disposed on at least one side of the support, and a plurality of decorations, which method comprises the steps of:

positioning the base on a horizontal surface;

mounting one or more first wall panels on the frame so that the wall panels stand upright with the decorative surfaces facing inwardly;

placing decorations in positions on or near the wall panels to form a first scene;

removing the first wall panels from the frame;

mounting one or more second wall panels on the frame so that the wall panels stand upright with the decorative surfaces facing inwardly, wherein the second wall panels have different decorative surfaces than the first wall panels; and repositioning decorations to create a second scene different from the first scene.

17. The method of claim 16, wherein the first wall panels have decorative surfaces on opposite faces thereof, and the second wall panels comprise the first wall panels disposed in a reversed position.

18. The method of claim 16, wherein the first wall panels and second wall panels are physically separate from one another.

19. The method of claim 16, wherein at least one of each of the first and second wall panels comprises a support, a decorative cover disposed on at least one side of the support, and a magnetically attractable layer disposed on the one side of the support beneath the cover layer, and one or more of the decorations are magnetically attractable, wherein at least one of the decorations and the magnetically attractable layer of the wall panel comprises a magnetic material, such that the steps of placing and repositioning decorations further comprise mounting one or decorations on covers of the wall panels by means of magnetic attraction.

20. An interchangeable panel display system, comprising:

a frame including four wall sections which include four posts mounted at four corners of the base and four upper beams spanning the four posts, wherein at least three wall sections comprise an open rectangular frame defined by:

a pair of parallel posts mounted at two adjacent corners of the base with one of the beams spanning upper ends of the pair of posts, each post of the pair having a longitudinal, inwardly facing groove for slidably receiving the wall panel therein, and the beam having a slot therethrough in alignment with the grooves in the posts, which slot comprises the opening in the frame for inserting a wall panel;

a base, the base comprising four lower beams spanning the four posts at lower end portions thereof and a base panel disposed on the lower beams, and at least one wall panel slidably insertable into and removable from the grooves of a wall section, the wall panel comprising a support including a decorative cover and magnetically attractable layer disposed on one side if the support beneath the cover.

* * * * *